US009065178B2

(12) United States Patent
Gyenes

(10) Patent No.: US 9,065,178 B2
(45) Date of Patent: Jun. 23, 2015

(54) RAPID TUNING FREQUENCY ADJUSTABLE MOBILE HF COMMUNICATION ANTENNA

(76) Inventor: Charles M. Gyenes, Wildomar, CA (US)

( * ) Notice: Subject to any disclaimer, the term of this patent is extended or adjusted under 35 U.S.C. 154(b) by 423 days.

(21) Appl. No.: 13/602,261

(22) Filed: Sep. 3, 2012

(65) Prior Publication Data

US 2014/0062814 A1 Mar. 6, 2014

(51) Int. Cl.

| | |
|---|---|
| ***H01Q 9/00*** | (2006.01) |
| ***H01Q 9/30*** | (2006.01) |
| ***H01Q 1/36*** | (2006.01) |
| ***H01Q 21/30*** | (2006.01) |
| *H01Q 1/32* | (2006.01) |

(52) U.S. Cl.

CPC ..... *H01Q 9/30* (2013.01); *H01Q 1/3258* (2013.01); *H01Q 1/36* (2013.01); *H01Q 21/30* (2013.01)

(58) Field of Classification Search

USPC ..... 343/702, 745

See application file for complete search history.

(56) References Cited

U.S. PATENT DOCUMENTS

| | | | | |
|---|---|---|---|---|
| 5,134,349 | A * | 7/1992 | Kruse | 318/400.34 |
| 5,793,331 | A * | 8/1998 | Anzai et al. | 343/702 |
| 6,496,154 | B2 * | 12/2002 | Gyenes | 343/745 |

* cited by examiner

*Primary Examiner* — Hoang V Nguyen
*Assistant Examiner* — Hai Tran
(74) *Attorney, Agent, or Firm* — William L. Chapin

(57) ABSTRACT

A mobile high-frequency antenna rapidly adjustable to minimize VSWR and maximize transmitting and receiving efficiency includes a conductive whip mounted on a coil housing containing a solenoidal loading coil electrically connected at an upper end to the whip and at a lower end to a conductive mast which supports the coil housing. A coil contactor disk at the upper end of a conductive metal shaft raised or lowered by a stepper motor-driven lead screw has protruding spring loaded balls which rollingly contact inner surfaces of coil turns to thus insert less or more inductance between the shaft and whip to tune the antenna. A pair of RF de-couplers in a coil housing base plug which electrically contacts the mast and the lower end of the coil slidably support and electrically contact the shaft, thus shorting out lower parts of the coil to suppress harmonic currents from being induced therein.

21 Claims, 12 Drawing Sheets

RAPID TUNING FREQUENCY ADJUSTABLE MOBILE HF COMMUNICATION ANTENNA

BACKGROUND OF THE INVENTION

A. Field of the Invention

The present invention relates to antennas used to transmit and receive high frequency (HF) radio signals in the approximate range of 2 MHZ to 30 MHZ. More particularly, the invention relates to an HF monopole antenna which is attachable to a motor vehicle and which is rapidly tunable to maximize efficiency of transmitting and receiving radio signals at different selected frequencies contained in a relatively wide band.

B. Description of Background Art

Two-way radio communications between locations spaced apart at substantial distances, e.g., tens, hundreds or thousands of miles apart cannot utilize direct line-of-sight paths, because of the curvature of the earth's surface. Therefore, such radio communications use radio frequency signals which operate in a high frequency range, e.g., 2 MHZ to 30 MHZ, because radio signals in the HF range are reflected from the earth's ionosphere. Thus, HF radio signals can be transmitted obliquely upwards towards the ionosphere, and bounced back towards the earth beyond the visual horizon Signals which are reflected from the ionosphere and impinge the earth's surface can also be reflected back towards the ionosphere. In this way, multiple consecutive reflections of signals between the ground and the ionosphere can provide an effective means of transmitting HF signals over long distances. The ionosphere is electrically conductive and hence, effective in reflecting radio signals because of the presence of charged particles consisting of positively charged gas molecules and electrons which have been stripped from neutral molecules by impacting particles or energetic photons.

Because the ionized particles of atmospheric gases in the ionosphere are created largely by radiation from the sun, the concentration of ionized particles varies widely on a daily basis. As can be readily understood, the production of ionized particles overhead during daylight is greater than during nighttime. However, the re-combination of ions to form neutral atoms to thus decrease the concentration of ions depends on many variables, such as upper atmosphere winds. Moreover, in addition to diurnal variation in ion concentrations in the atmosphere, a variation in the sun's output of protons, which can be substantial, causes the ion concentration in the ionosphere to vary in unpredictable ways.

It is an observed and theoretically understand fact that the reflectivity of radio signals from the ionosphere depends both on the concentration of ions in the ionosphere, and upon the frequency of HF radio signals which are incident upon the ionosphere. Therefore, as is well know to HAM radio operators, as well as government agencies such as U.S. military services which communicate via HF radio signals, that it is often necessary to adjust the frequency of transmitted HF signals to values which are most effectively reflected from the ionosphere, to maximize the strength of a radio signal received at a distant location.

In addition to temporal variations of the reflectivity of the ionosphere which make adjustability of HF radio signal frequencies desirable there are spatial variations. Thus, for example, the optimum frequency for most effectively bouncing a transmitted signal from the ionosphere from a transmitter to a receiver station due North of the transmitter may differ from the optimum frequency for transmitting a signal to a receiver located West of the transmitter.

There are other reasons why it would be desirable to provide a HF communication link with frequency adjustability. For example, it is sometimes required that a fixed command and control site base station transmit different messages to different remote fixed or mobile receivers. Thus, by sending a sequence of messages, each at a different pre-selected frequency, a different message can be sent from a central command and control site to different intended recipients. Moreover, an operator at either a base station or a remote site can adjust the frequency of a transmitted radio signal and inquire of the distant recipient which frequencies provide the strongest received signals.

Also, it is possible to enhance the security of a radio frequency signal transmission by a technique known as frequency-hopping, in which information such as a voice communication message or a data stream is partitioned or time divided into a sequence of packets, each of which is sent sequentially at a different RF-carrier frequency.

In U.S. Pat. Nos. 6,275,195 and 6,496,154, the present inventor disclosed a frequency adjustable mobile monopole antenna that uses a circular shorting disk which is slidably moved by a motor-driven lead screw within the bore of a solenoidal loading coil disposed between a base mast and radiating whip section of a mobile monopole antenna. By moving the shorting disk up or down to contact and short-out a larger or smaller number of the coil turns, the inductance of the loading coil can be reduced or increased to cause the antenna to resonate at higher or lower selected frequencies. The disclosed frequency adjustable antenna has proven to be highly effective in performing its intended task of providing a frequency adjustable mobile antenna which can be reliably tuned by remote motor command signals to adjust the inductance of the loading coil to values which optimize transmission and reception efficiency over a wide band of frequencies. However, a need has remained for an adjustable frequency mobile monopole communication antenna which can be very rapidly tuned to thus meet greater speed-demanding applications such as frequency-hopping mentioned above. The present invention was motivated at least in part by this received need.

OBJECTS OF THE INVENTION

An object of the present invention is to provide a rapid tuning frequency adjustable mobile communication antenna which enables the antenna to efficiently transmit and receive radio signals over a relative wide range of selectable frequencies, particularly in the high frequency (HF) band between 2 MHz and 30 MHz.

Another object of the invention is to provide a rapid tuning frequency adjustable mobile HF communication antenna that is a linear monopole type and includes a vertically aligned assembly which has a lower electrically conductive mast section, an adjustable inductance loading coil section electrically connected to the upper end of the mast section, and an upper radiating whip section electrically connected to the upper end of the loading coil section, the loading coil section including a solenoidal coil which has an inductance that may be rapidly varied between precisely pre-determined values.

Another object of the invention is to provide a rapid tuning frequency adjustable mobile HF communication antenna which has an elongated solenoidal loading coil that has disposed through its bore a circular contactor disk which electrically contacts inner conductive surfaces of the coil wire turns and is supported at the upper end of a longitudinally movable carrier shaft that is in electrically conductive contact with the lower end lead of the coil, thus enabling the carrier shaft to move the coil contactor disk to precisely determined longitudinal locations to thereby short-out lower turns of an adjustable member of lower coil turns to thus reduce the inductance of the coil to precisely determined values.

Another object of the invention is to provide a rapid tuning frequency adjustable mobile HF communication antenna which has a linearly actuatable loading coil shorting disk which is made of an electrically conductive material, the disk having protruding radially inwardly from an outer longitudinally disposed circumferential rim thereof a plurality of circumferentially spaced apart, radially inwardly disposed cylindrical cavities each holding a silver plated steel contactor ball and an elongated electrically conductive compression spring which urges the ball radially outwards into contact with inner sides of loading coil turns.

Another object of the invention is to provide a rapid tuning frequency adjustable mobile HF communication antenna which has a solenoidal loading coil having disposed within its bore a shorting disk that is supported by an axially rearwardly disposed conductive carrier shaft which is rapidly extendable and retractable within the bore by means of a lead screw driven by a rotary stepper motor operated in a closed loop servo mode.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a Rapid Tuning Frequency Adjustable Mobile High Frequency (HF) Radio Communication Antenna for use with radio transceivers, particularly those used in motor vehicles. The antenna according to the present invention is a monopole type, sometimes referred to as a Marconi antenna, that has a vertically elongated body which is intended to be used in a vertical orientation to transmit and receive vertically polarized radio frequency signals in the approximate range of 2 MHz to 30 MHz.

The antenna according to the present invention includes a lower electrically conductive hollow tubular mast section which has at the lower end thereof a mounting bracket that is electrically isolated from the mast, and fastenable to a support structure such as a vehicle or bumper which serves as ground plane. The mounting bracket includes a plate which has an electrical insulated eyelet bushing disposed through its thickness dimension. The eyelet bushing has disposed through its bore a feed wire which is electrically conductively connected at a proximal end to the mast and which is connectable at a distal end to the high potential terminal of a radio transceiver via the isolated center conductor of a flexible coaxial cable.

The antenna according to the present invention includes a longitudinally elongated cylindrically-shaped hollow loading coil tube which is fixed to the upper end of the mast section in coaxial alignment therewith. The coil tube is made of an electrically non-conductive material such as polycarbonate and has formed in the inner cylindrical wall surface thereof an elongated helical groove. The groove holds conformally therewithin convolutions or turns of an electrically conductive loading coil wire which forms a uniform diameter, longitudinally elongated solenoidal coil.

The lower end of the loading coil is electrically conductively connected to a disk-shaped conductive metal base plug which is threadably received in electrically conductive contact with lower end turns of the loading coil, and fixedly attached to the coil tube. The lower end of the base plug is electrically conductively connected to the upper end of the mast, which supports the base plug.

The upper end of the coil tube supports therein an electrically conductive cap which is threadably inserted into and fixedly attached to the coil tube, in electrically conductive contact with upper end turns of the loading coil wire.

A conductive metal clamp which protrudes upwardly from the upper end of the coil tube cap receives the lower end of an elongated conductive flexible whip section of the antenna which protrudes upwardly from the center of the upper end cap. Thus constructed, the antenna according to the present invention comprises a vertically elongated electrically conductive structure which has a conductive mast, a solenoidal loading coil within an elongated insulated coil tube mounted on the upper end of the mast, and an antenna whip section which extends upwardly from the upper end of the coil tube, which is effective in transmitting and receiving vertically polarized electromagnetic radiation at radio frequencies.

The loading coil is electrically connected in series with the upper end of the antenna mast and the lower end of the whip, which is the primary radiating element of the antenna. As is known to those skilled in the art, adding inductance in series with the radiating element of a linear monopole antenna increases the effective electrical length of the antenna. Thus, for example, if the physical length of the antenna is 2.5 meters, which is equal to one quarter-wave of a 10-meter, 30-MHZ electromagnetic wave, the antenna is resonantly tuned, and operates at maximum efficiency for both transmitting and receiving 30-MHZ signals. However, the 2.5 meter length is much shorter than a quarter of a wave length of 2-MHZ signal, and thus is very inefficient in launching and receiving the lower frequency 2-MHZ signals. This is because at low frequencies the length of the antenna is substantially shorter than a quarter of a wave length, causing the antenna impedance to have a large negative reactive component, i.e., capacitive component.

By placing a loading coil in series with the monopole antenna, the positive reactance of the inductance of the coil opposes the negative capacitive reactance of the radiating element of the antenna, thus decreasing the magnitude of the reactive component of the antenna input impedance and thereby increasing the effective electrical length of the antenna to a value greater than its physical length. By a suitable choice of the value of the inductance of the loading coil, the effective length of a monopole antenna can be increased to a value much closer to one-quarter of a wavelength of lower frequency signals, and thus increase the input impedance of the antenna to a value which more closely matches the output impedance of a radio transceiver connected to the antenna. Such impedance matching minimizes signal reflections and improves efficiency of launching and receiving lower frequency signals.

In the present inventor's U.S. Pat. Nos. 6,275,195 and 6,496,156, a monopole antenna was disclosed which included a vertically disposed loading coil longitudinally aligned with a lower conductive mast section and an upwardly protruding whip section. The antenna disclosed in the present inventor's above-cited patents included a commutator or coil contactor which contacted the inner surfaces of the loading coil turns. The contactor was extendible by means of a motor-driven lead screw from a lower, maximum inductance position at which the commutator contacted the lowest turns of the loading coil, where the inductance of the loading coil was a maximum for tuning the antenna to a low frequency, and extendable to an upper limit position. In the upper limit position, an electrically conductive, shorting path was established between lower coils at the lower end of the loading coil and upper coil turns or convolutions located near the upper end of the loading coil. Thus, with the coil contactor extended to an upper position, the lower turns of the loading were shorted out. This shorting action reduced the value of the inductance in series with the mast and whip sections of the antenna, thus enabling the operating frequency of the antenna to be adjusted to higher values.

The presently disclosed frequency adjustable antenna has a structure and function which are similar to the present inventor's prior-disclosed frequency adjustable antenna. However, the presently disclosed frequency adjustable antenna has novel structural and functional characteristics which enable the antenna loading coil to transition between precisely controllable positions at very rapid rates.

The rapid and precise positioning of the coil contactor is facilitated by a novel coil contactor disk which is mounted to the upper end of a tubular carrier or actuator shaft. The coil contactor disk includes a plurality of circumferentially spaced apart, radially disposed cavities, each of which holds a silver plated steel contactor ball which is biased radially outwards by a conductive helical compression spring. The contact balls collectively form a very low electrical resistance path between the contactor disk and the inner conductive surfaces of a longitudinally disposed solenoidal loading coil wire. Moreover, the contact balls are free to rotate and thus present minimum resistance to rapid linear motion of the contactor disk within turns of the loading coil.

According to the present invention, a minimum electrical resistance and minimum frictional resistance, tubular support of the contact disk carrier shaft is provided by a pair of longitudinally spaced apart toroidally-shaped RF de-coupler rings which bear resiliently against the outer cylindrical wall surface of the longitudinally movable carrier shaft. Each decoupler ring is made from an elongated leaf spring which has an arcuately curved outer surface. The leaf spring is bent into a toroidal shape to position the curved surfaces of the spring sections in electrically conductive, slidable contact with the outer wall surface of the carrier shaft.

According to the invention, rapid reciprocating upward and downward motion of the carrier shaft to thus rapidly position the coil contactor disk at precisely repeatable longitudinal locations within the loading coil is facilitated by a novel lead screw drive mechanism. The latter employs a permanent magnet stepper motor which has an integral shaft angle encoder that provides a feed-back signal which enables the stepper motor to be operated in a closed-loop servo motor mode. In this mode, positioning accuracy and speed are increased and motor drive power requirements are decreased, from those of a stepper motor used in a customary open-loop mode.

DESCRIPTION OF THE PREFERRED EMBODIMENT

FIGS. 1-23 illustrate the structure and function of a rapid tuning frequency adjustable mobile HF communication antenna according to the present invention.

Figure 1:
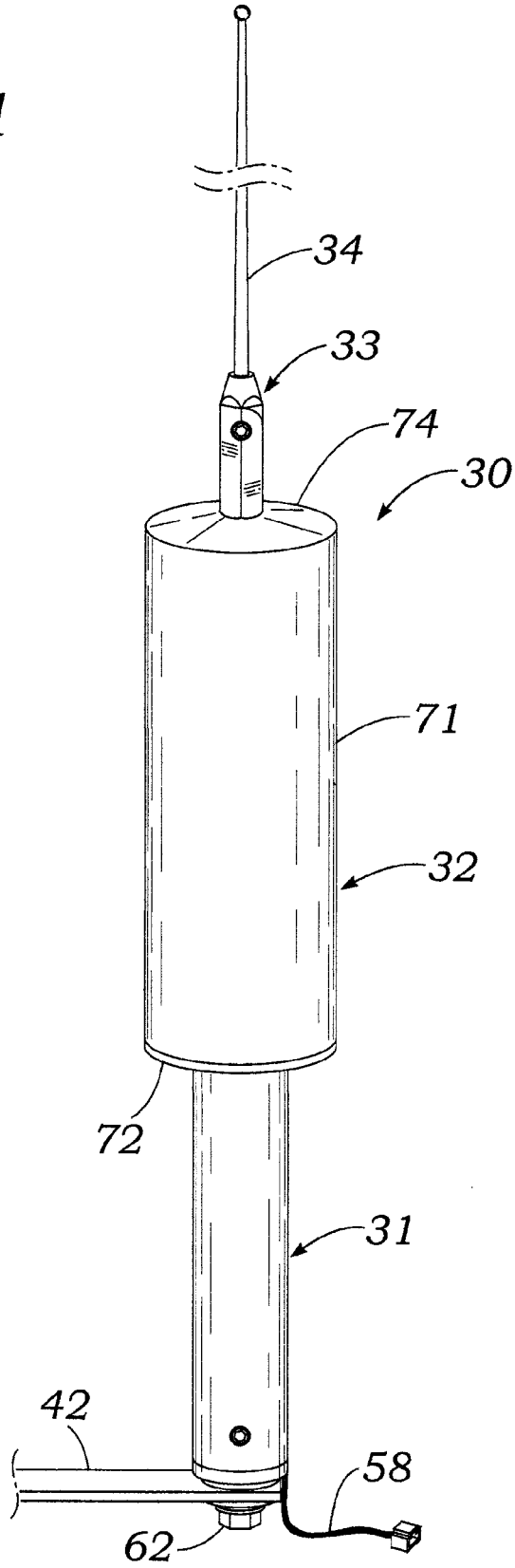
FIG. 1 is a front elevation view of a Rapid Tuning Frequency Adjustable Mobile HF Communication Antenna according to the present invention.

Referring first to FIG. 1, it may be seen that a rapid tuning frequency adjustable mobile HF communication antenna 30 according to the present invention has generally the shape of a straight, vertically elongated tubular body that consists of a coaxially aligned, vertical stack of circular cross-section cylindrically-shaped sections. The sections of antenna 30 include a bottom cylindrically-shaped tubular mast section 31 which has a diameter of about 2.5 inches and a length of about 2¼ feet. The mast section 31 has attached coaxially to its upper end an axially aligned coil tube section 32, which has a diameter of about 5½ inches, and a length of about 13 inches.

Antenna 30 includes a whip section 33 which has an elongated flexible whip antenna rod 34 which has a diameter of about ⅛ inch that extends perpendicularly upwards from the center of a conductive upper end cap 74 of the coil tube section 32. Whip antenna 34 is made of a conductive metal, and typically has a length which is selected to resonate at a particular radio frequency. In the present case, antenna 30 is intended to be used as a monopole type antenna that extends vertically upwards from a ground plane. The resonant length of monopole whip is ¼ of a wavelength. Thus, for operation at 30 MHz, e.g., at a wavelength of 1 meter, whip 34 would have a length of about 2.5 meters, i.e., about 8 feet.

Figure 2:
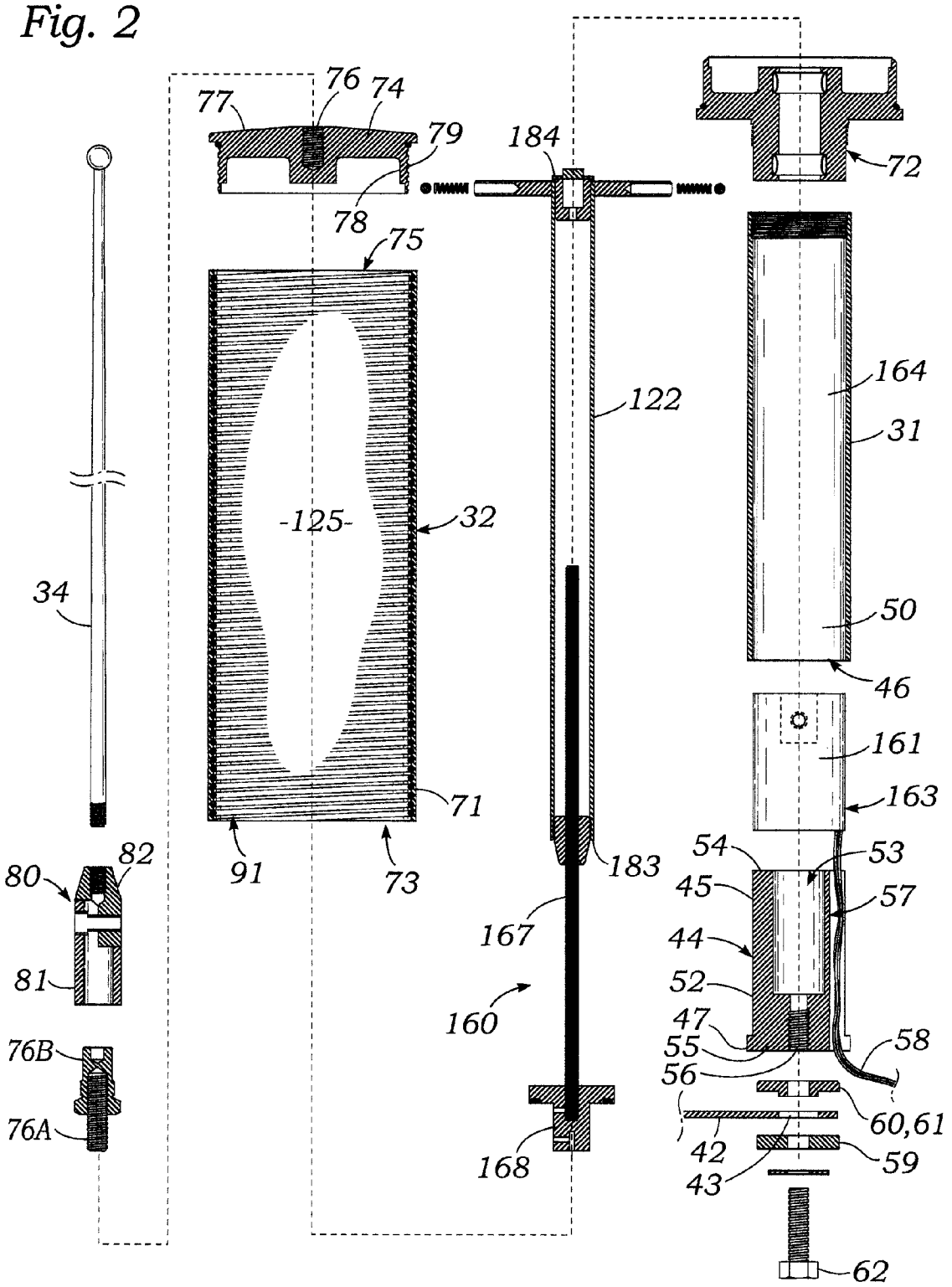
FIG. 2 is an exploded longitudinal sectional view of the antenna of FIG. 1.
Figure 4:
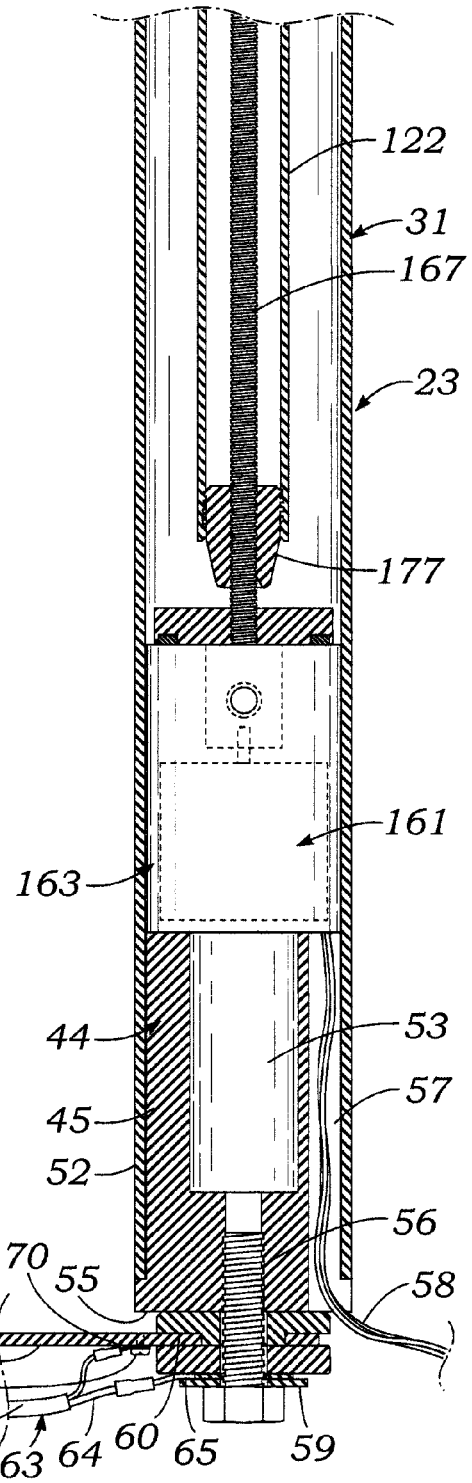
FIG. 4 is a fragmentary sectional view of the antenna of FIGS. 1 and 2 on an enlarged scale, showing a lower part of the antenna.

As shown in FIGS. 1, 2 and 4, frequency adjustable antenna 30 according to the present invention includes a mounting assembly 40 for mounting the antenna to a structural component of a vehicle such as a bumper. The mounting assembly 40 has a bracket 41 which includes a flat rectangular metal plate 42 that has through its thickness dimension a vertically disposed bolt hole 43.

As shown in FIGS. 2 and 4, mounting assembly 40 for attaching the lower end of tubular mast section 31 in an upstanding orientation to a structural component of a vehicle includes a cylindrically-shaped mast mounting plug 44. Mast mounting plug 44 has an upper elongated cylindrically-shaped body section 45 which is slipped upwardly into the bore 46 of tubular mast section 31. Upward travel of mounting plug 44 into bore 46 of mast tube 31 is limited by a thin, enlarged diameter annular base flange 47 located at the lower end of the mounting plug. Mounting plug 44 is secured to mast tube section 31 by screws 48 inserted through holes 49 disposed radially through the wall 50 of the mast section tube, and tightened into aligned threaded holes 51 which are disposed radially inwardly into body 45 of the plug from its outer cylindrical wall surface 52.

As shown in FIGS. 2 and 4, mast base mounting plug 44 preferably has a relatively large diameter central coaxial weight-reducing bore 53 which is disposed downwardly into the body 54 of the plug from its upper circular end face 54.

As is also shown in FIGS. 2 and 4, mast base mounting plug 44 has extending upwardly into body 45 from lower circular end face 55 thereof a coaxially centrally located, threaded mounting bolt hole 56.

Referring still to FIGS. 2 and 4, it may be seen that the body 45 of mounting base plug 44 has formed in the outer cylindrical wall surface 52 thereof a generally semi-circular cross-section longitudinally disposed groove 57 which extends the entire length of the plug and thus penetrates upper and lower end faces 54 and 55 of the plug. Groove 57 is provided to receive a motor controller cable 58.

As shown in FIGS. 2 and 4, mounting assembly 40 of mast section 31 includes lower and upper insulating washers 59, 60 which are located below and above bracket plate 42 of bracket 41, with central coaxial bores of the washers axially aligned with bolt hole 43 through the bracket plate. A flanged insulated bushing 61 is inserted downwardly through the aligned bores of upper insulating washer 60, bracket bolt hole 43, and lower insulating washer 61. Mast section 31 is secured to bracket 41 in electrically isolated relationship to the bracket by means of a conductive metal bolt or cap screw 62 which is inserted upwardly through lower insulating washer, through bracket bolt hole 43, through insulating flange bushing 61 and threadably tightened into threaded mounting bolt bore 56 that extends upwardly into body 45 of mounting plug 44 from the lower end face 55 of the plug body.

As may be understood by referring to FIG. 4, mast section 31 of antenna 30 is electrically interconnected with a radio transceiver (not shown) by a coaxial cable 63 which has a central conductor 64 terminated by a conductive metal eyelet 65 that is secured between lower insulator 59 and bolt head 67 in electrically conductive contact with the bolt head. Coaxial cable 63 also has an outer flexible braided conductive metal shield lead 68 which is secured in electrically conductive contact to conductive metal bracket plate 42 by means of a screw 69 which is inserted through a conductive metal eyelet 70 and threadably tightened into a threaded bore 71 in the bracket plate.

Figure 3:
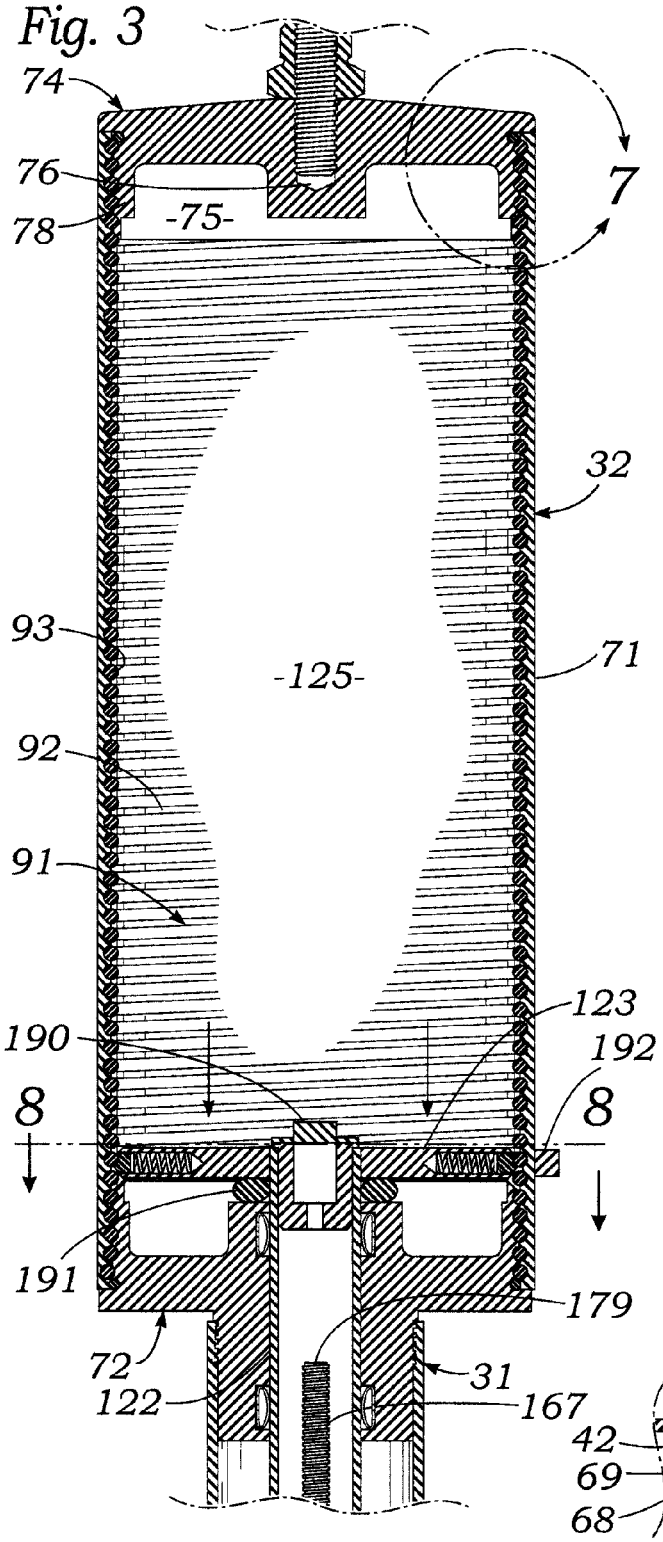
FIG. 3 is a fragmentary sectional view of the antenna of FIGS. 1 and 2, on an enlarged scale, showing an upper part of the antenna.
Figure 6:
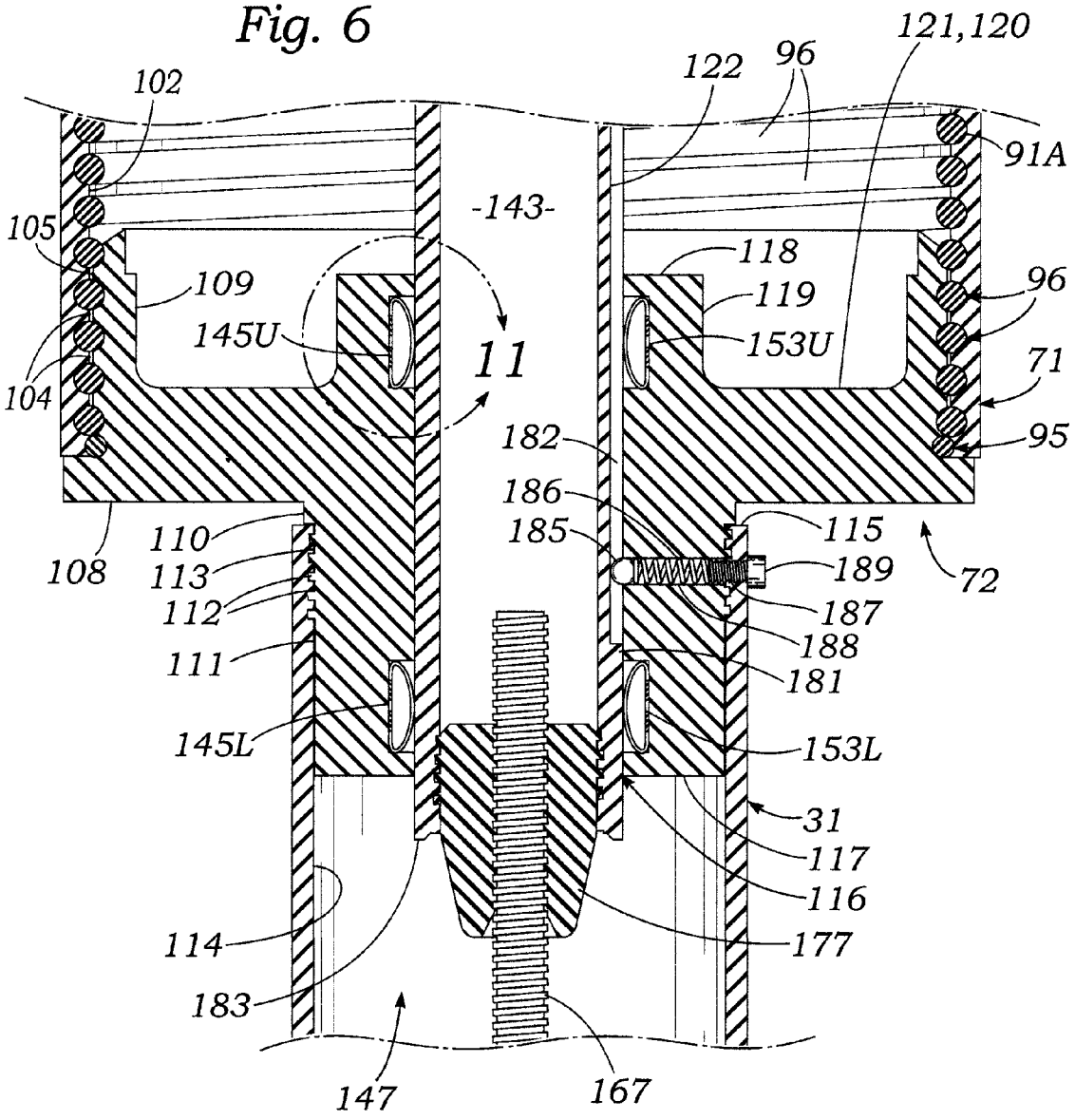
FIG. 6 is a fragmentary sectional view of the antenna of FIG. 3 on an enlarged scale, showing a lower part of a coil section of the antenna.

Referring now to FIGS. 1-3, it may be seen that coil tube section 32 of antenna 30 includes a longitudinally elongated, cylindrically-shaped tubular coil housing 71. Coil tube housing 71 is made of a durable, high-dielectric strength material such as polycarbonate plastic. As shown in FIGS. 2 and 6, coil tube housing 71 is mounted to the upper end of tubular mast section 31, in coaxial alignment therewith, by means of a metal base plug 72 which fits coaxially within the lower end opening 73 of the coil tube housing 71, and coaxially over the upper end of the mast section.

As shown in FIGS. 1-3 and 7, antenna 30 includes a conductive metal cap 74 of antenna fits coaxially within the upper end opening 75 of coil tube housing 71. Cap 74 is provided with a coaxial centrally located blind threaded bore 76 that extends downwardly into the cap from the upper surface 77 of the cap. Cap 74 has a lower skirt section 78 which has an external helical thread 79. Cap 74 also has threadably fastened into blind bore 76 a threaded stud 76A which is threadingly received upwardly into a plug 76B which is in turn received in the lower fixed part 81 of a fold-over coupler 80.

Figure 5:
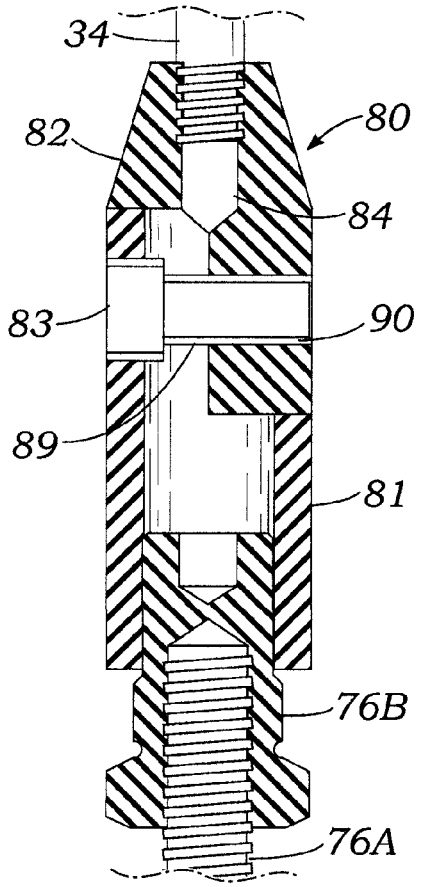
FIG. 5 is a fragmentary view of the antenna of FIGS. 1 and 2, showing an antenna whip coupler component of the antenna.

As shown in FIG. 5, fold-over coupler 80 also includes an upper part 82 which is attached to lower part 80 by means of a transversely disposed bolt or screw 83. Upper part 82 of coupler 80 has extending downwards from an upper end face 84 thereof a blind bore 85 for receiving the lower end 86 of elongated flexible antenna whip section 34. Whip section 34 is retained in bore 85 by a clamp set screw 87. Upper part 82 of coupler 80 is pivotable or foldable with respect to lower coupler part 81 to thus position whip section 34 at an orientation inclined or folded downwards from an upright vertical position, to avoid interference when a vehicle on which the antenna is mounted encounters reduced overhead clearance, such as when the vehicle is traveling through a tunnel. Pivotable motion between upper part 82 and lower part 81 of coupler 80 is enabled by a pivot joint 88 which includes a pivot pin consisting of screw 83 disposed laterally through holes 89, 90 in the lower and upper coupler parts.

Referring now to FIGS. 2-3, it may be seen that antenna 30 includes a longitudinally elongated solenoidal electrical coil 91 which is formed from a length of silver plated wire that is formed into a helix and pressed conformally into a longitudinally elongated helical groove 92 formed in the inner wall surface 93 of coil tube housing 71. In an example embodiment of antenna 30, coil 91 was wound from 12-gauge silver plated brass wire. Coil 91 has a lower end portion 94 which is in electrically conductive contact with metal base plug 72 at the lower end of coil tube housing 71. Coil 91 also has an upper end portion 95 which is in electrically conductive contact with cap 74 at the upper end of the coil tube housing 71.

As shown in FIG. 6, base plug 72 is secured to the lower end of coil tube housing 71 in electrically conductive contact with lower end turns or convolutions 96 of coil 91. Cap 74 is secured to the upper end of the coil tube housing 71 in electrically conductive contact with upper end turns 98 of the 91, by similar means, as shown in FIGS. 6 and 7.

Figure 7:
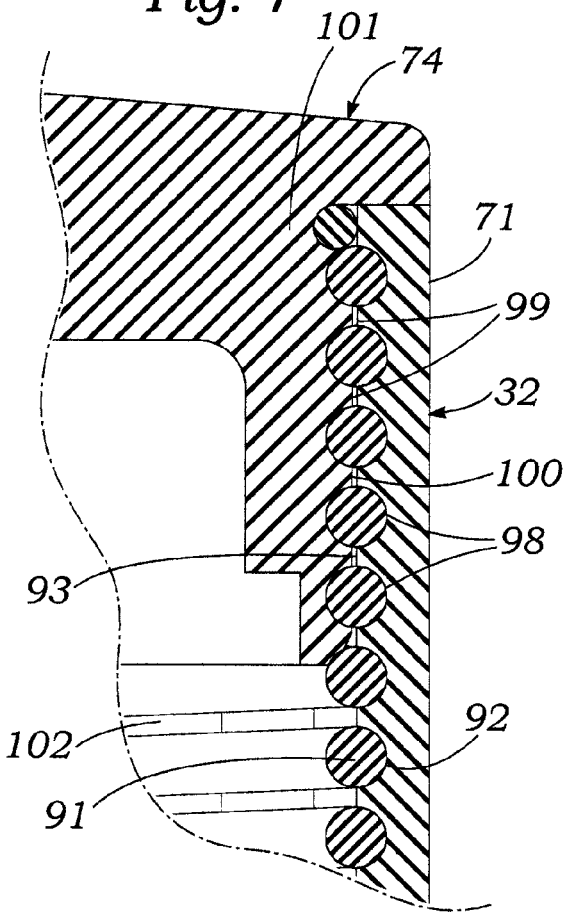
FIG. 7 is a fragmentary sectional view of the antenna of FIG. 3, showing an upper part of a loading coil section of the antenna.

Referring to FIG. 7, it may be seen that metal cap 74 is preferably secured to coil tube housing 71 by means of external helical threads 99 in the outer cylindrical surface 100 of a lower reduced diameter, downwardly depending portion 101 of cap 74. The threads 99 are threadingly received in a helical groove 102 located between upper end turns 98 of coil 91, which protrude radially inwardly of the inner cylindrical wall surface 93 of the coil tube housing.

Similarly, as shown in FIG. 6, metal base plug 72 of antenna 30 is provided with external helical threads 104 in the outer cylindrical wall surface 105 of a reduced diameter, upwardly depending upper portion 106 of the base plug. The threads 104 are threadingly received in a lower part of helical groove 102 located between lower end turns 96 of coil 91, which protrude radially inwardly of the inner cylindrical wall surface 93 of the coil tube housing.

As, shown in FIG. 6, base plug 72 has protruding downwardly from the lower circular face 108 of the upper cylindrical cap-shaped end portion 109 thereof a tubular reduced diameter, cylindrically-shaped neck section 110. Neck section 110 is coaxially aligned with the upper large diameter end portion 109 of base plug 72, and has formed in the outer cylindrical wall surface 111 of the lower neck section a longitudinally disposed, helical external thread 112. As shown in FIG. 6, lower threaded neck section 110 of coil base plug 72 is threadably received in an internal helical thread 113 formed in the inner cylindrical wall surface 114 of mast tube 31 which extends downwardly from its upper transverse annular end wall 115.

Referring still to FIG. 6, it may be seen that coil tube base plug 72 has disposed through its length a central circular cross-section coaxial bore 116. Bore 116 extends longitudinally through base plug 72 from a lower transverse end face 117 thereof to an upper-transverse annular end face 118 of the base plug. As shown in FIG. 6, the upper transverse annular end face 118 of coil base plug 72 which is penetrated by bore 116 is located at the upper end of a reduced diameter upper neck section 119 that extends upwardly from the upper surface 120 of the circular disk-shaped base 121 of the base plug. As will be described below, coaxial bore 116 through coil tube base plug is provided to longitudinally, slidably hold a tubular carrier shaft 122 which supports at its upper end a circular disk-shaped coil contactor disk 123 of a coil contactor 124.

FIGS. 2, 3 and 8-10 illustrate the structure and function of novel coil contactor 124 according to the present invention. The coil contactor 124 includes coil contactor disk 123 which is longitudinally movable in electrically conductive contact with inner surfaces of coil wire 97 in coil tube housing 71, thus shorting out an adjustable number of lower coil turns to thereby lower the inductance presented in series between mast 31 and cap 74, in a manner which will now be described.

As may be understood best by referring to FIGS. 3 and 8-10, circular disk-shaped coil contactor disk 123 of antenna 30 fits coaxially within a longitudinally disposed, central coaxial bore 125 through coil 91 in tube housing 71. Coil contactor disk 123, which is made of an electrically conductive material such as aluminum, longitudinally slidably contacts the inner circumferential surface 126 of wire turns 127 of coil 91.

Figure 9:
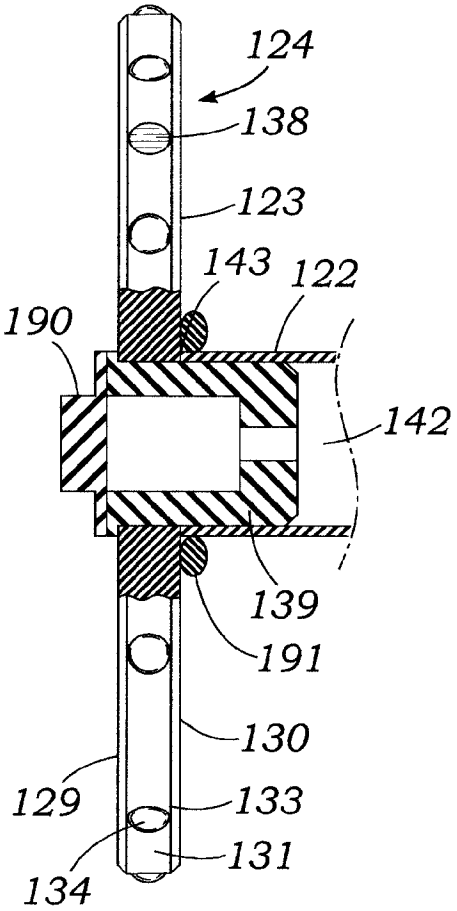
FIG. 9 is a side elevation view of the coil contactor disk of FIG. 8.
Figure 8:
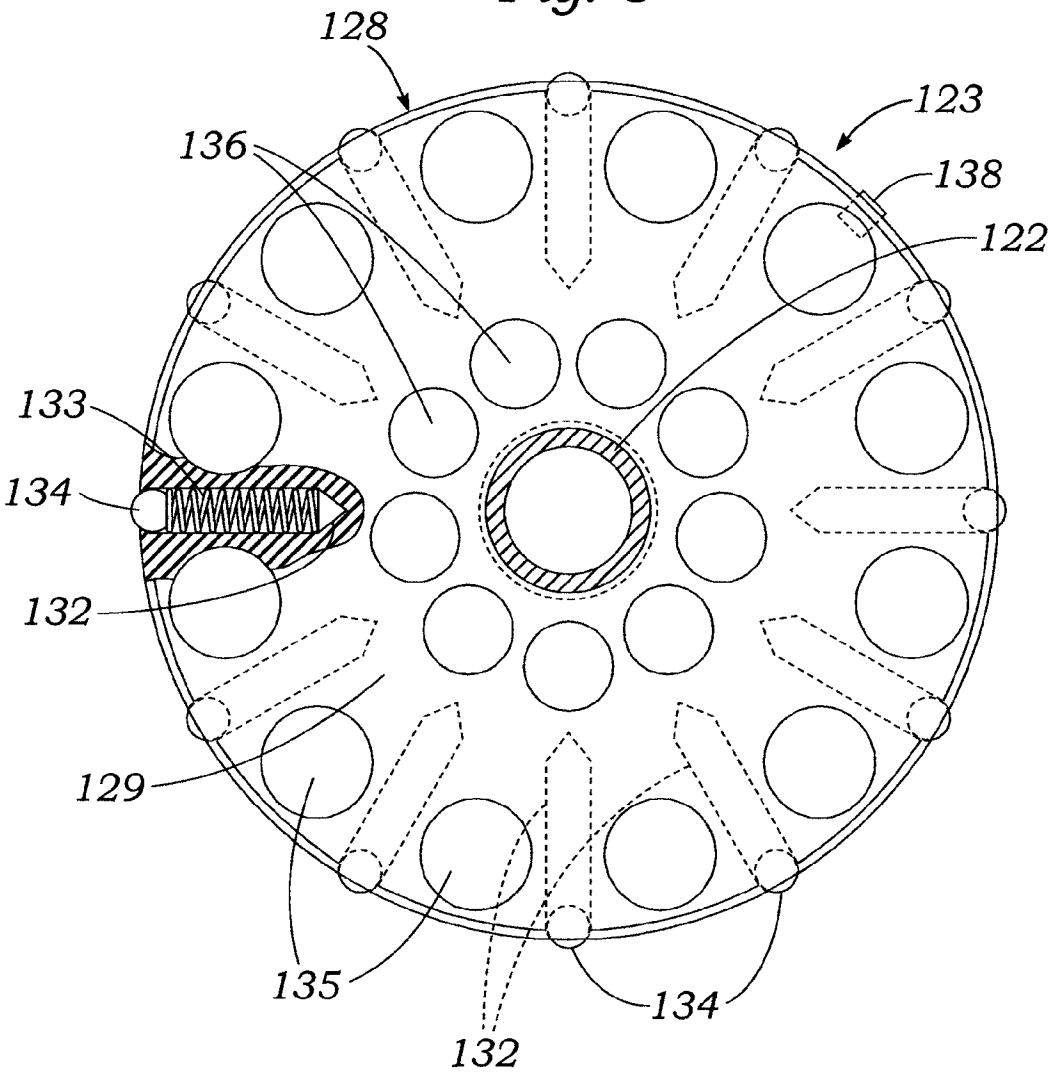
FIG. 8 is an upper end elevation view of a coil contactor disk part of the antenna of FIG. 2.
Figure 10:
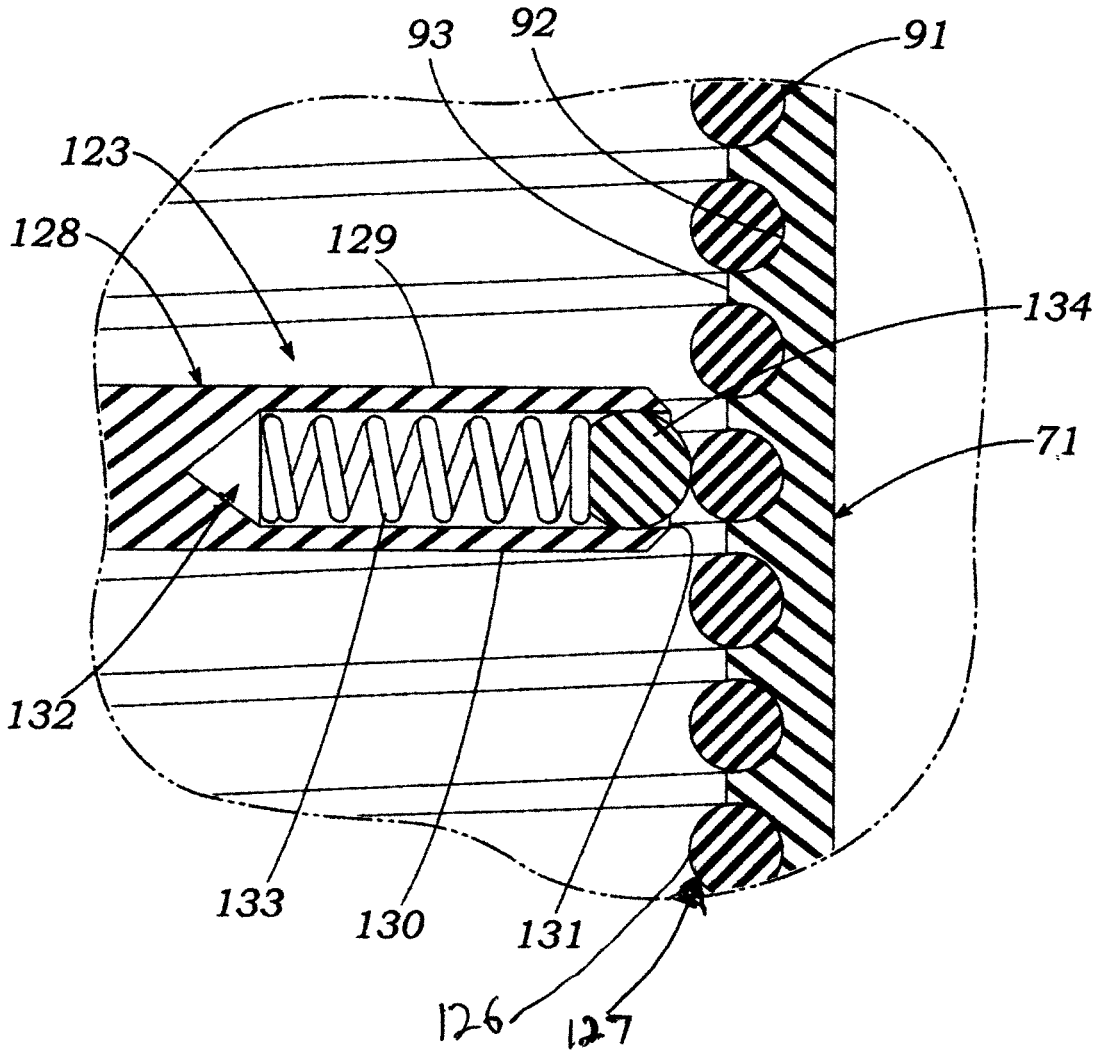
FIG. 10 is a fragmentary sectional view of the antenna of FIG. 3 on an enlarged scale, showing the coil contactor disk and loading coil thereof.

As shown in FIGS. 8-10, coil contactor disk 123 includes a body 128 which has the shape of a thin, uniform thickness circular disk. Body 128 of contactor disk 123 is preferably made of a light weight, electrically conductive material such as aluminum. As shown in FIGS. 8 and 9, body 128 has flat, parallel upper and lower faces 129, 130, a longitudinally disposed, circular band-shaped outer circumferential edge wall 131 which is disposed perpendicularly between the upper and lower faces.

As shown in FIGS. 8 and 9, body 128 of contactor disk 123 has extending radially inwardly from outer circumferential edge wall 131 thereof a sequence of cylindrically-shaped cavities 132 which are spaced circumferentially apart at equal intervals. Although the number, depth, diameter and spacing of cavities 132 is a matter of design choice, an example embodiment of contactor disk 123 tested by the present inventor had a diameter of 4¾ inches, and had 12 cavities 132 each having a diameter of about 0.257 inch and a depth of about 1 inch which were spaced apart at 30-degree intervals on the outer circumferential edge wall 131 of circular disk body 128.

As shown in FIGS. 8 and 10, each cavity 132 holds radially slidably therewithin a radially disposed, open-coil helical compression spring 133. Each compression spring 133 is made of an electrically conductive material such as silver plated brass, and presses resiliently in a radially outwardly direction against a silver plated steel coil contactor ball 134 which has a diameter slightly less than diameter of cavity 132, i.e., 0.250 inch and thus is radially movable with the cavity.

As may be understood by referring to FIGS. 3 and 10, the novel construction of contactor disk 123 enables it to move longitudinally within coil 91 with coil contactor balls 134 in rolling electrically conductive contact with inner circumferential surface 126 of coil turns 127, thus providing a rolling electrically conductive contact between contactor disk 123 and coil 91 which has very low electrical and frictional resistances.

As shown in FIG. 8, coil contactor disk 123 preferably has through its thickness dimension a series of lightening holes to reduce the weight and hence inertia of the disk. Thus, for example, in the example embodiment of contactor disk 123 shown in FIG. 8, body 128 of the contactor disk had an outer circle of twelve 0.625-inch diameter circular outer lightening holes 135 spaced apart at 30-degree intervals. The example embodiment of coil contactor disk 123 shown in FIG. 8 also had an inner circle of nine 0.500-inch diameter circular inner lightening holes 136, which were located adjacent to a central circular coaxial shaft bore 137 through disk body 128.

As shown in FIGS. 8 and 9, coil contactor disk 123 preferably includes an indicator component consisting of a small cylindrically-shaped permanent magnet 138 which is held in a shallow cylindrically-shaped cavity 135 that is located between a pair of ball-and-spring cavities 132. The function of indicator magnet 138 is described below.

As shown in FIGS. 2-4, 6 and 9, a central coaxial shaft bore 142 through coil contactor disk 137 receives therein a cylindrical cup-shaped fastener insert 139 which is insertably received and fixed in the upper opening of bore 143 through tubular support or carrier shaft 122.

As may be seen by referring to FIGS. 2-4 and 6, support shaft 122 of contactor disk 123 is positioned coaxially within bore 144 of mast tube section 131, and is reciprocally movable up and down within the bore.

Referring now to FIG. 6, it may be seen that base plug 72 of antenna 30 includes a pair of longitudinally spaced apart, upper and lower RF decoupler rings 145U and 145L. The function of RF decoupler rings 145U, 145L is to provide a low electrical resistance, low sliding friction contact between the body of base plug 72, which is in electrically conductive contact with the upper end of conductive mast tube 31, and the outer cylindrical wall surface 156 of support carrier tube 122 of coil contactor disk 123. By providing this low electrical resistance path, RF decoupler rings 145U, 145L provide a low resistance shorting path between the contactor disk 123 and the lower end lead of loading coil 91. By providing this lower electrical resistance shorting path, turns of coil 91 located below the coil contactor disk 123 are shorted out or "decoupled," thus reducing the inductance between the antenna whip 34 connected to the upper end lead of the coil, and the mast 31 connected to the lower end of the coil.

As shown in FIGS. 6 and 11-13, each decoupler ring 145 is formed from an elongated rectangular metal strip 146 which has upper and lower straight, parallel edges 147, 148 that have cut perpendicularly inwards at equal longitudinal intervals thin, shallow rectangularly-shaped notches 149, 150, respectively. In an example embodiment of antenna 30, metal strip 146 of de-coupler ring 145 was made of silver plated beryllium copper.

Figure 12:
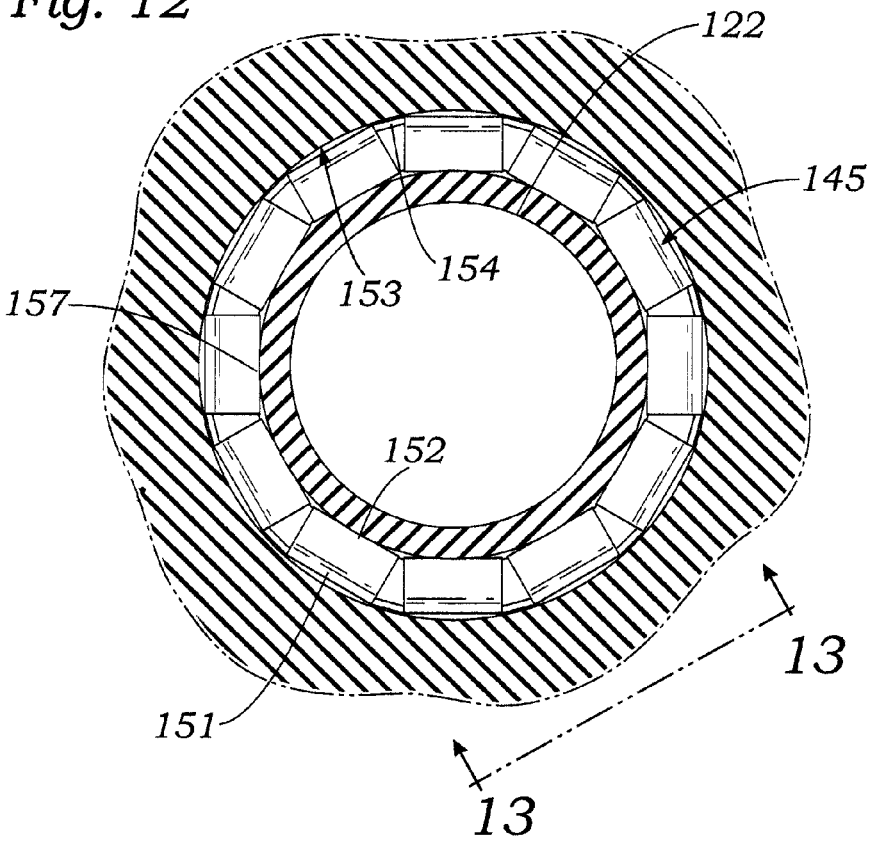
FIG. 12 is a transverse sectional view of the decoupler ring and carrier shaft of FIGS. 6 and 11.
Figure 11:
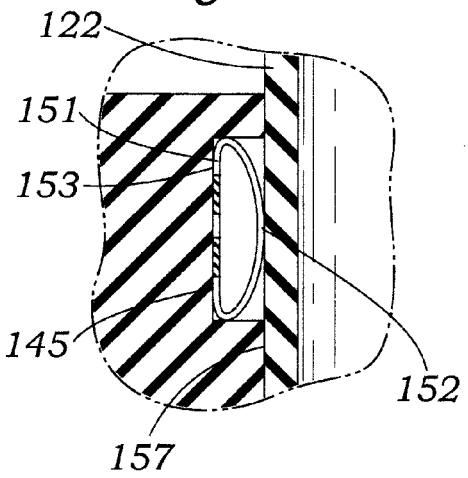
FIG. 11 is a fragmentary longitudinal sectional view of the antenna of FIGS. 3 and 6, showing one of two RF decoupler rings of the antenna with the inner circumferential surface of the ring in resilient, longitudinally slidable contact with the outer surface of a conductive carrier shaft which supports at the upper end thereof the coil contactor disk of FIGS. 8 and 9.
Figure 13:
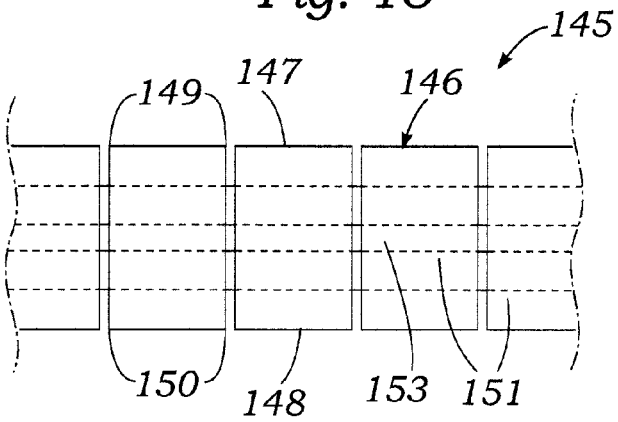
FIG. 13 is an enlarged lineal sectional view of a spring strip from which the decoupler ring of FIGS. 11 and 12 is formed.

As shown in FIGS. 11-13, the notches 149, 150 enable the metal strip 146 to be bent into a series of laterally spaced apart rings 151 that have in a transverse cross-sectional view a lenticular shape with an arcuately curved convex outer surface 152.

As shown in FIG. 12, after metal strip 146 has been worked to form therein a series of lenticular rings 151, the strip is bent into a toroid-like shape, with the arcuately curved convex surface 152 of the ring lying on a circle inscribed within the cylinder defined by the outer bent base surface 153 of the strip. As shown in FIGS. 6, 11, 12 and 14-15, toroidal ring-shaped decoupler contactor rings 145U, 145L are then inserted into annular cavities 153U, 153L formed in the inner cylindrical wall surface 154 of upper and lower sections 155, 156 of base plug 72. In these locations the outer arcuately curved convex surface 152 of each ring slidingly contacts the outer surface 157 of coil contactor disk carrier shaft 122.

FIGS. 2-4, 6, 17 and 18 illustrate structure and function of a rotary motor-driven linear actuator mechanism 160 for extending and retracting coil contactor disk 123 upwardly and downwardly within bore 125 through coil 91. Upward and downward motion of the coil contactor disk 123 causes more or less turns of coil 91 to be shorted out, thus decreasing or increasing the inductance in series with mast 31 and antenna whip 34. Decreasing or increasing the inductance in series with mast 31 and whip 34 enables antenna 30 to be tuned for optimum impedance matching with a radio transceiver at higher or lower relative operating frequencies, respectively.

As, shown in FIGS. 2, 4, and 16-18, linear actuator mechanism 160 of coil contactor 124 includes a stepper motor 161. Stepper motor 161 has generally the shape of a rectangular block, and is mounted within a rectangular block-shaped cavity 162 in a motor mount housing 163 which has the shape of a right circular cylinder. As shown in FIG. 4, motor housing 163 holding motor 161 fits coaxially within bore 164 through mast section 31, on top of mast mounting plug 44. Motor mount housing 163 is made of an electrically non-conductive material such as a structural plastic to maintain electrical isolation between motor 161 and mast section 31.

Figure 18:
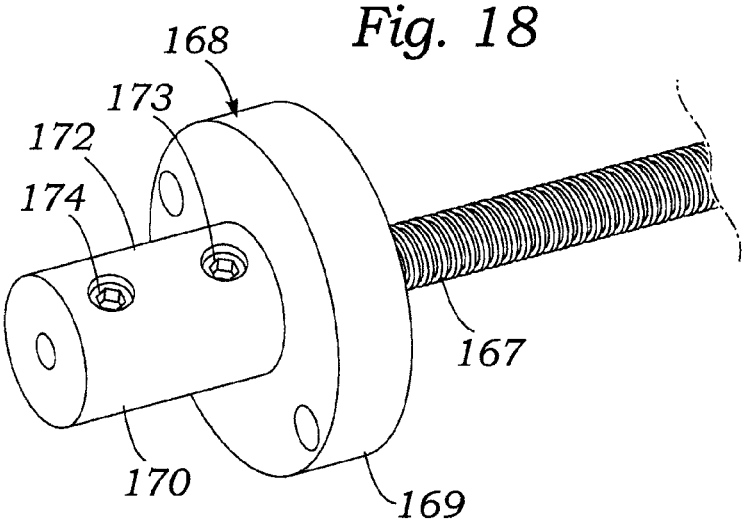
FIG. 18 is a fragmentary view of the antenna of FIGS. 2 and 4, showing a lead screw coupler and lead screw of the antenna.
Figure 14:
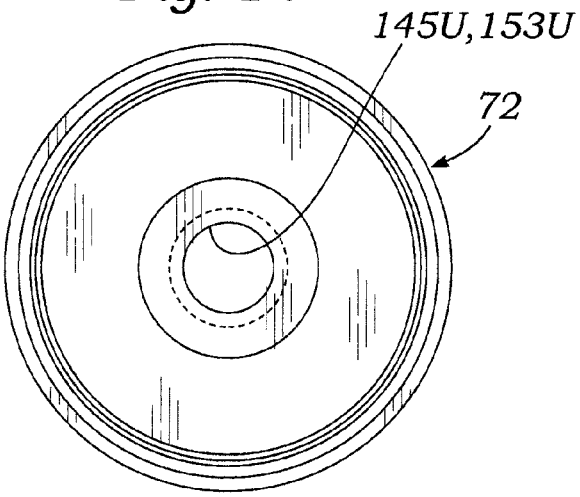
FIG. 14 is an upper plan view of a lower end cap part of the antenna of FIG. 2, showing a decoupler ring of FIGS. 11-13 installed in the lower end cap.
Figure 17:
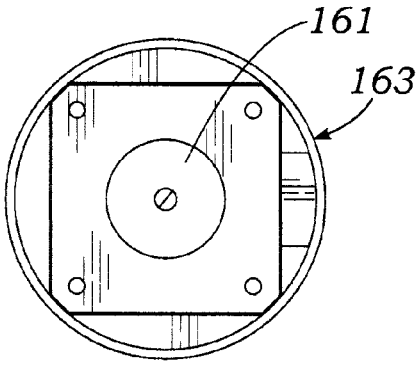
FIG. 17 is an upper plan view of the motor housing of FIG. 16.
Figure 15:
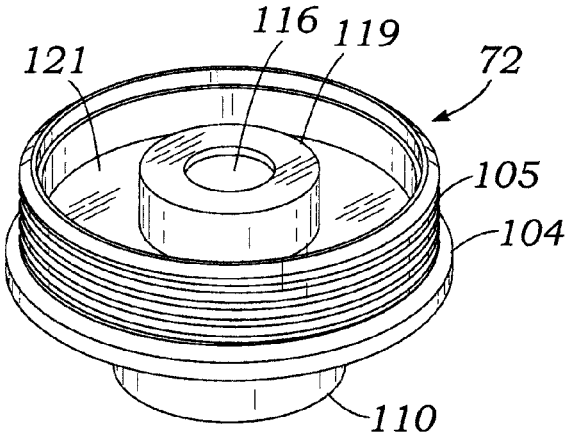
FIG. 15 is an upper perspective view of the end cap of FIG. 14.
Figure 16:
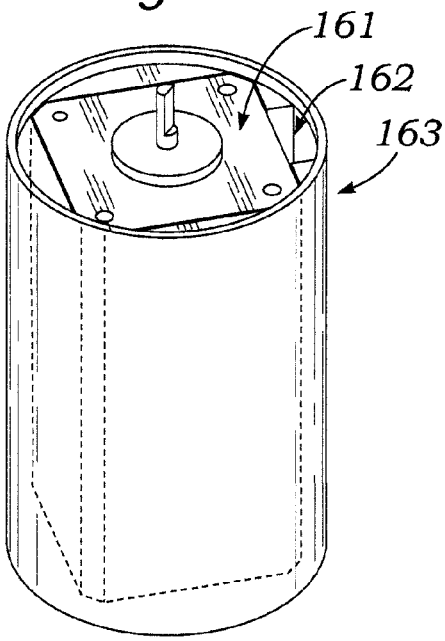
FIG. 16 is a perspective view of a motor housing of the antenna of FIG. 2.

Motor 161 has protruding upwards from an upper transverse end face 165 thereof a rotary output shaft 166. As shown in FIGS. 4 and 18, motor shaft 161 is connected by a lead-screw coupler 168 to an elongated straight lead screw 167 which extends upwardly from motor 161 in axial alignment with the motor shaft. As shown in FIG. 14, coupler 168 includes an upper short cylindrical disk-shaped part 169, a lower elongated cylindrical section 170 which extends downwardly from the lower annular face of the upper disk section, and a bore 171 which extends through both upper and lower sections of the coupler. Coupler 168 has disposed radially inwardly into the outer cylindrical wall surface 172 of lower section 170 thereof an upper set screw 173 for tightening onto lead screw 167, and a lower set screw 174 for tightening onto motor shaft 166.

As shown in FIGS. 2 and 4, motor controller cable 58 is connected at a proximal end thereof to rotary motor 161, and is disposed through groove 57 through base plug 44 of mast section 31 to an electrical motor controller 175 (not shown) located external to antenna 30.

In a preferred example embodiment of antenna 30 according to the present invention, motor 161 was a high pole-count, 2-phase permanent magnet stepper motor model number QCI-A17H-3S0061, which was obtained from Quicksilver Controls Inc., 712 Arrow Grand Circle, Covina Calif. 91722, USA. That motor includes a shaft angle encoder which provides a position feed back signal that is used by a controller, model number QCI-D2-IG-J to operate the motor in closed-loop, 2-phase, A-C servomotor mode, rather than in the conventional open-loop mode used to drive a stepper motor. The use of shaft angle position feedback to adjust the drive current of motor 161 in a closed loop mode enabled the lead screw 173 to be rotated at higher speeds to more precisely determinable angular positions than could be achieved using a stepper motor in an open-loop mode, and used less electrical power in operation.

In an example embodiment of antenna 30 using the above-described motor and motor drive electronics, the antenna was tunable over a frequency range from about 2 MHZ to about 30 MHZ, in which contactor disk travel was about 12 inches, in about 700 milliseconds. This extremely fast tuning rate facilitates operation of the antenna 30 in such applications as Frequency Hopping and Automatic Link Establishment (ALE).

According to the invention, the controller which provides drive currents to motor 161 preferably is programmable to enable a user of antenna 30 to select input commands to the controller which cause the motor to drive coil contactor disk 123 to a any one of a large number of pre-determined longitudinal positions within coil 91 that tune the antenna to a corresponding large number of discrete frequency channels in the range of 2-30 MHZ. In an example embodiment of antenna 30, software used with the motor controller enabled the selection of 500 different frequency channels, and had the capability of being expanded to 2000 channels.

FIGS. 3, 4 and 6 illustrate how controller 175 is used provide drive signals to motor 161 which enable coil contactor disk 123 to be positioned upwardly and downwardly rapidly within bore 125 of coil 91 to thus rapidly decrease or increase the inductance of coil 91 in series with mast section 31 and antenna whip 34 to precisely adjustable values.

As shown in FIGS. 3, 4 and 6, tubular coil contactor disk support shaft 122 has threadably received in a lower internally threaded entrance section 176 of bore 143 through the support shaft a lead screw follower nut 177 which has the shape of an externally threaded plug shaped like an inverted frustum of a cone. Lead screw follow nut has disposed though its length a central threaded bore 17 which threadingly receives the upper end of lead screw 167.

Figure 23:
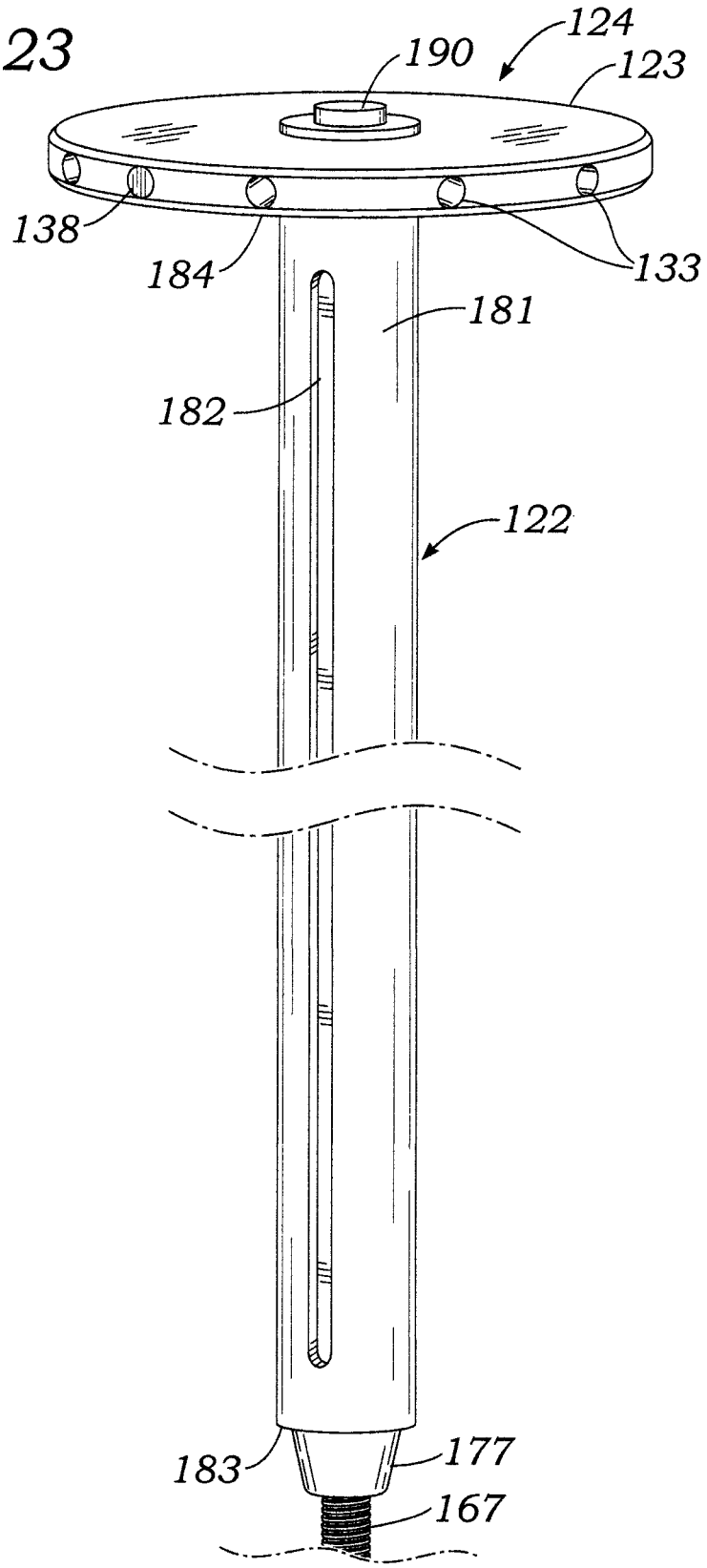
FIG. 23 is a fragmentary view of the antenna of FIG. 2 showing a coil contactor thereof.

Antenna 30 preferably has a construction which prevents carrier shaft 122 and ball contactor disk 123 from rotating in response to torques exerted on lead screw follower nut 177 when the lead screw is rotated by motor 161. Thus, as shown in FIGS. 6 and 23, carrier shaft 122 has formed in its outer cylindrical wall surface 181 an elongated shallow, U-shaped groove 182 which extends from a short distance above lower end face 183 of the shaft to a short distance below upper end face 184 of the carrier shaft. Groove 182 receives resiliently therein a ball 185 which is urged radially inwardly by an open-coil helical compression spring 186 disposed through radial bore 187 through mast section 31, and an aligned radial bore 188 disposed through lower neck section 110 of coil tube housing 78. Ball 185 and spring 186 are held in place by a set screw 189 threaded into bore 188.

With motor shaft 179 rotated to a maximum counterclockwise position, as viewed from above the upper end face 180 of lead screw 167, carrier support shaft 122 of coil contactor disk 123 is retracted to a lower limit position, at which the inductance presented by coil 91 in series with mast section 31 and antenna whip 34 is a maximum value in an example embodiment of antenna, the inductance of coil 91 was about 350 microhenup.

Figure 19:
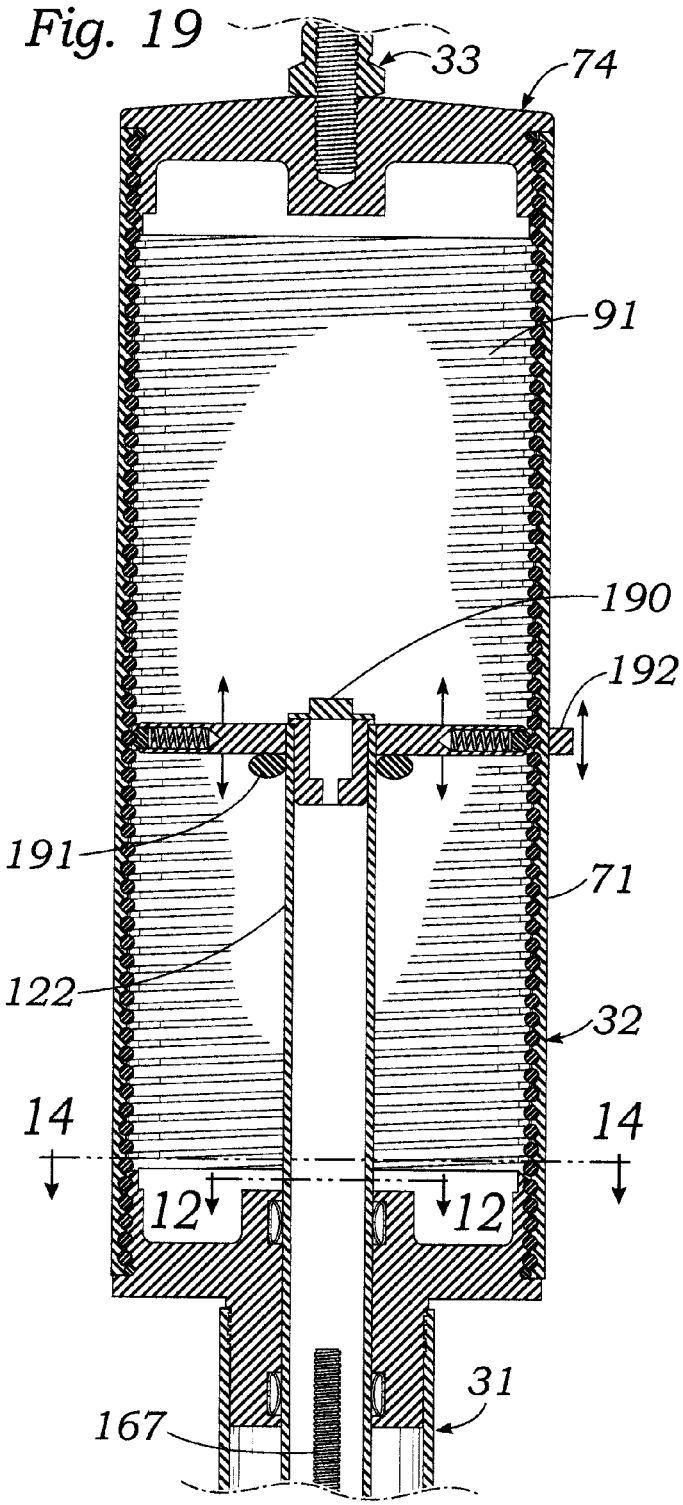
FIG. 19 is a partly broken away view showing the coil tube contactor disk of the antenna in an intermediate, longitudinal position that has an intermediate inductance.
Figure 20:
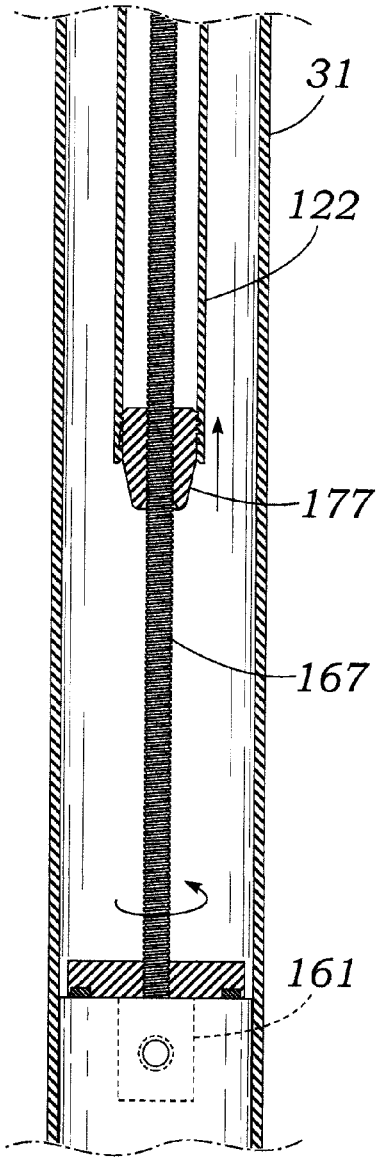
FIG. 20 is a fragmentary view of the mast, lead screw, follower nut and coil contactor support shaft for the configuration of FIG. 19.

As shown in FIGS. 19 and 20, when motor 161 has received drive currents sufficient to rotate motor shaft 179 and lead screw 167 a sufficient number of turns in a clockwise sense, follower lead screw nut 177, coil contactor disk support shaft 122, and coil contactor disk 123 will be extended upwardly to, for example, a location midway through the length of bore 125 through coil 91, as shown in FIG. 19.

In intermediate longitudinal positions of contactor disk 123 within bore 125 of coil 92, electrical contact is made between the contactor disk and one or more turns 127 of coil 91, located at the same longitudinal position within bore 125 of coil 91 as coil contactor disk balls 134. The coil contactor balls 124 are also in electrical contact with coil contactor disk carrier shaft 122, which is in slidable electrical contact with decoupler rings 145U and 145L. Also, the decoupler rings 145U, 145L are in electrically conductive contact with the conductive body of base cap 74, which is in turn in electrically conductive contact with lower turns 127 of coil 91. Thus, as shown in FIG. 19, when coil contactor disk 123 is located longitudinally midway within bore 125 of coil 91, those turns 127 of coil 91 located between the coil contactor disk and plug 74 below the coil contactor disk are shunted by and hence shorted out by the low resistance electrical path descried above. Therefore, for the position of coil contactor disk 123 shown in FIG. 19, the inductance between mast section 31 and antenna whip 34 is reduced to about one-half of the value of the inductance for the lower limit position of the coil contactor disk 123 shown in FIG. 3. Also, the lower turns of coil 91 are shorted out, thus suppressing any harmonic currents which might otherwise be induced in the lower coil turns.

Figure 21:
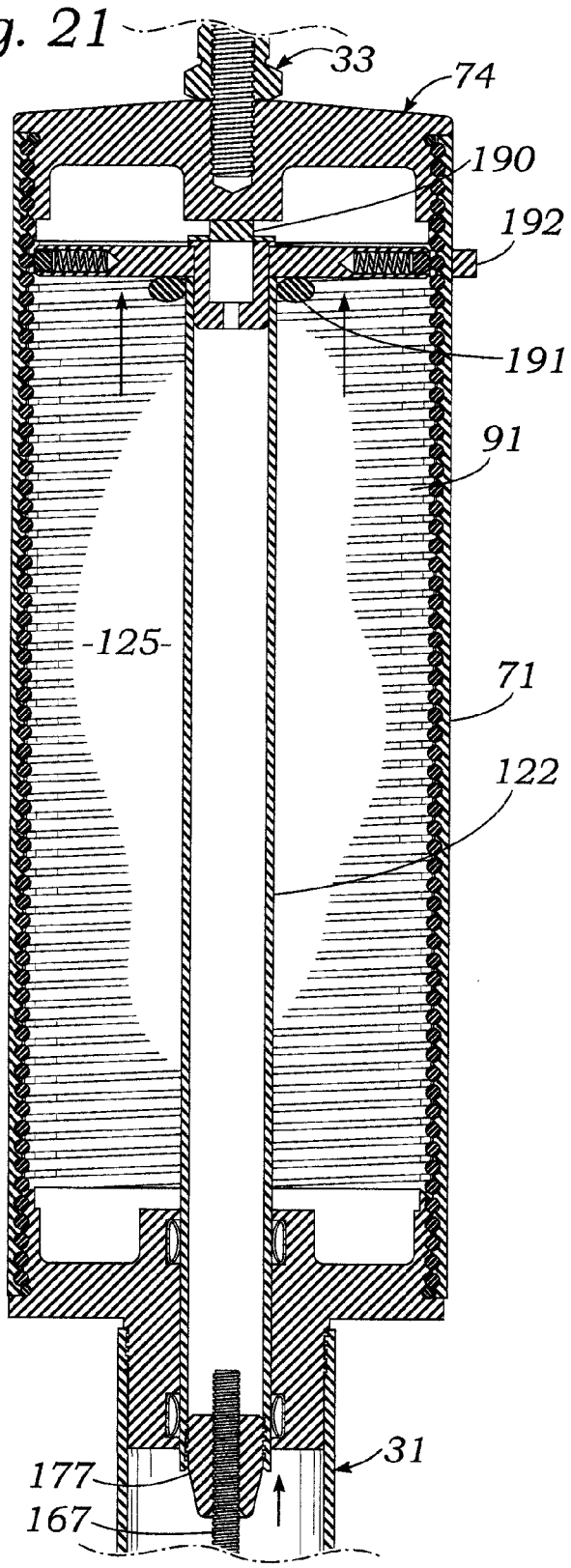
FIG. 21 is a partly broken away view showing the coil contactor disk at a fully extended, minimum inductance position.
Figure 22:
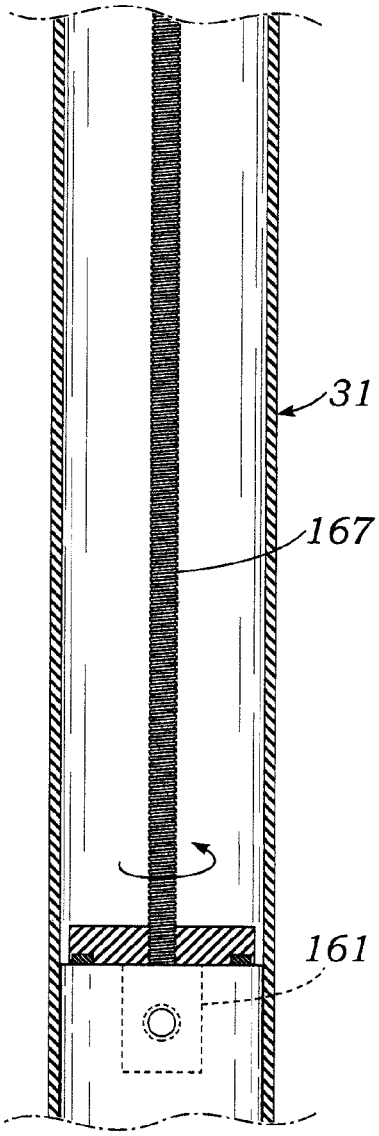
FIG. 22 is a fragmentary view of the mast and lead screw for the configuration of FIG. 21.

As shown in FIGS. 21 and 22, when motor 161 has received for a sufficiently long period of time a clockwise drive signal, follower nut 177, coil contactor disk support shaft 122 and coil contactor disk 123 will be extended upwardly to the upper limit of travel of the coil contactor disk. At this position, the coil contactor disk 123 shorts out substantially all of the turns 127 of coil 91, thus reducing the inductance in series with mast section 31 and antenna whip 34 to a minimum value which approaches zero.

As shown in FIGS. 3, 9, and 21, coil contactor 124 preferably includes a cylindrically-shaped rubber bumper 190 which protrudes coaxially upwards from the center of fastener plug 139 in coil contactor disk 23.

As may be understood by referring to FIG. 21, contact of the upper surface of bumper 190 with the lower surface of coil housing cap 174 at the upper travel limit of coil contactor support shaft 122 and coil contactor disk 123 causes the bumper to elastically deform, thus absorbing impact shock and returning elastically stored energy to the contactor disk, thus facilitating rapid reversal of upward motion of the contactor disk 123 to downward motion.

As shown in FIG. 3, coil contactor 124 also preferably includes a resilient elastomeric O-ring 191 which fits coaxially over the upper end of contactor support shaft 122 which contacts the lower surface of coil contactor disk 123.

As my be understood by referring to FIG. 3, contact of the lower surface of O-ring 191 with the upper surface of coil assembly base cup 72 at the lower travel limit of coil contactor support shaft 122 and coil contactor disk 123 causes the O-ring to elastically deform, thus absorbing shock and returning elastically stored energy to the contactor disk, thus facilitating rapid reversal of downward motion of the coil contactor disk to upward motion.

FIGS. 3, 19 and 21 illustrate how indicator magnet 138 mounted in the periphery of coil contactor disk 123 is used to provide an external visual indicator of the longitudinal position of the coil contactor disk within coil housing tube 71. As shown in FIG. 3, a small cylindrically-shaped permanent magnet 192 is placed on the outer surface 193 of coil housing tube 71, in magnetic adherence to indicator magnet 138 within bore 125 of coil 91 inside the coil housing tube. Then, as shown in FIGS. 19 and 21, as the coil contactor disk 123 is moved upwards or downwards within coil housing tube 71, external indicator magnet 192 slides along the outer surface 193 of the coil housing tube magnetically adhered to internal indicator magnet 138, thus indicating the longitudinal position of coil contactor disk 123 within the housing.

What is claimed is:

1. A frequency adjustable antenna for radio transceivers operable over a range of radio frequencies comprising;

a. a lower electrically conductive base mast section with a radio frequency connection thereto, b. an elongated hollow cylindrical housing made of an electrically non-conductive material and having formed in an inner cylindrical wall surface thereof a longitudinally disposed helical groove, c. an electrically conductive loading coil comprised of a conductor formed into longitudinally spaced apart convolutions comprising a helix of the same pitch as said helical groove in said housing, and fitting within said helical groove with an inner cylindrical surface of said helix located radially inward of said inner cylindrical wall surface of said housing, each of said coil convolutions having a radially inwardly located arcuately curved convex surface, d. a base plug located at a lower end of said housing, sad base plug being in electrically conductive contact at a lower end thereof with said mast section and at an upper end thereof with a lower end of said coil, e. a cap adapted to hold in electrical contact therewith an elongated conductive whip located at an upper end of said housing, said cap being in electrical conductive contact with an upper end of said coil, f. an elongated conductive coil contactor support shaft located coaxially within said mast and said coil, g. a coil contactor carried by and in electrically conductive contact with said conductive shaft, said coil contactor including a transversely disposed disk which has extending radially inwardly into a longitudinally disposed outer peripheral circumferential wall thereof at least at first pair of circumferentially spaced apart, radially disposed cavities, each of said cavities holding a radially movable electrically conductive contactor ball which is urged radially outwards by a compressed electrically conductive helical compression spring located within a said cavity between a said contactor ball and a transverse inner end of said cavity with sufficient force to maintain continuous rolling electrically conductively contact between a radially outwardly located surface of a said contactor ball a radially inwardly located arcuately curved convex surface of at least one of said coil convolutions when said coil contactor disk is moved longitudinally within the bore of said loading coil, said contactor balls having a diameter larger than longitudinal spacing between said convutions of said loading coil, said compression spring, contactor balls, and said convolutions of said loading coil each having an electrical conductivity at least as great as that of brass, h. at least a first RF de-coupler ring which is located in said electrically conductive cylindrical base plug, said RF de-coupler ring bearing resiliently and slidably against the outer cylindrical wall surface of said shaft longitudinally slidably located within a bore through said base plug, and I. an actuator for moving said conductive shaft and said coil contactor disk coaxially located within said bore of said loading coil longitudinally upward and downward to short out more or less coil turns in series with said whip and said mast, thereby decreasing or decreasing the inductance between said whip and said mast section to adjustably tune said antenna to higher or lower frequencies.

2. The frequency adjustable antenna of claim 1 wherein said coil convolutions are coaxial with said coil contactor disk.

3. The frequency adjustable antenna of claim 1 wherein said coil convolutions are coaxial with said cylindrical housing.

4. The frequency adjustable antenna of claim 3 wherein said base plug is coaxial with and projects upwardly from said mast section.

5. The frequency adjustable antenna of claim 4 wherein said housing is coaxial with and projects upwardly from said base plug.

6. The frequency adjustable antenna of claim 5 wherein said base plug is coaxial with said housing.

7. The frequency adjustable antenna of claim 6 wherein said conductive shaft carrying said coil contactor disk is guided coaxially within said mast by a guide opening in said base plug.

8. The frequency adjustable antenna of claim 1 wherein said mast is tubular, and wherein said actuator is a linear actuator which comprises in combination a reversible motor housed within a lower portion of said mast, a lead screw coupled to and protruding axially upward from a rotary output shaft of said motor, and an internally threaded follower nut secured to said conductive shaft, said lead screw threadingly engaging said follower nut.

9. The frequency adjustable antenna of claim 8 wherein said motor includes a shaft angle encoder.

10. The frequency adjustable antenna of claim 9 wherein said motor is supplied with drive currents from a closed-loop servo amplifier which includes as inputs a position command signal to position said coil contactor disk at a selected longitudinal position within said coil, and a shaft angle encoder feed-back signal.

11. The frequency adjustable antenna of claim 10 wherein said motor is further defined as a multi-pole, two-phase AC stepper motor.

12. The frequency adjustable antenna of claim 11 wherein said motor is driven in a four- quadrant, variable frequency servo loop.

13. The frequency adjustable antenna of claim 12 wherein electrical currents used to drive said motor are variable in frequency.

14. The frequency adjustable antenna of claim 13 wherein said drive currents are adjusted in response to continuous and periodic sampling of an error signal proportional to the difference between directed and actual positions of said motor shaft.

15. The frequency adjustable antenna of claim 1 wherein said first RF de-coupler ring is further defined as an electrically conductive annular ring-shaped spring, member comprised of a single longitudinally elongated rectangularly-shaped strip of resilient conductive material, upper opposed longitudinal edges of which are bent outwardly from the plane of the strip and thence axially inwardly towards a longitudinal center line of the strip to form two axially spaced apart rear, outer longitudinally disposed supporting band members, the inner, front surface of said strip continuous with said supporting band members being formed into an arcuately curved convex arched surface segmented into a plurality of longitudinally spaced apart arched tabs, said strip being bent into a ring-shaped loop having an axially disposed curvature axis coaxial with said conductive shaft to thereby arrange said tabs into an annular ring-shaped array having convex inner surfaces resiliently biased radially inwardly to contact an outer cylindrical surface of said conducive shaft.

16. The frequency adjustable antenna of claim 15 wherein said conductive material of said strip is further defined as being a beryllium copper alloy.

17. The frequency adjustable antenna of claim 15 wherein said first RF de-coupler ring is further defined as being located within a first annular groove located in a wall of said central coaxial bore through said base plug.

18. The frequency adjustable antenna of claim 17 further including a second RF de-coupler ring located within a second annular groove in said wall of said central coaxial bore through said base plug spaced axially from said first groove.

19. The frequency adjustable antenna of claim 1 further including an anti-rotation mechanism for preventing said shaft from rotating in response to torques transmitted to said shaft by said lead screw.

20. The frequency adjustable antenna of claim 19 wherein said anti-rotation mechanism includes in combination a longitudinally disposed groove in the outer surface of said shaft and an indexing member which protrudes into said groove from said base plug.

21. The frequency adjustable antenna of claim 20 wherein said indexing member is further defined as a ball biased radially inwardly into said groove by a spring.

* * * * *